US005939689A

United States Patent [19]

Roos

[11] Patent Number: 5,939,689

[45] Date of Patent: Aug. 17, 1999

[54] MATRIX-RELATED SWITCHING ARRANGEMENT INCLUDING MOVABLE RODS AND BALLS

[75] Inventor: Sture Gösta Roos, Bergshamra, Sweden

[73] Assignee: Telefonaktiebolaget LM Ericsson, Stockholm, Sweden

[21] Appl. No.: 09/000,361

[22] PCT Filed: Aug. 1, 1996

[86] PCT No.: PCT/SE96/00980

§ 371 Date: Jan. 28, 1998

§ 102(e) Date: Jan. 28, 1998

[87] PCT Pub. No.: WO97/06546

PCT Pub. Date: Feb. 20, 1997

[30] Foreign Application Priority Data

Aug. 4, 1995 [SE] Sweden ..... 9502753

[51] Int. Cl.[6] ..... H01H 1/16

[52] U.S. Cl. ..... 200/175; 335/118

[58] Field of Search ..... 200/175–177; 335/117, 118

[56] References Cited

U.S. PATENT DOCUMENTS

| | | | |
|---|---|---|---|
| 584,965 | 2/1897 | Leibundgut . | |
| 2,647,166 | 7/1953 | Lens | 179/27.54 |
| 3,614,330 | 10/1971 | Chauveneaud | 179/18 GE |
| 3,662,301 | 5/1972 | Willis . | |
| 4,954,674 | 9/1990 | Roos | 200/175 |
| 5,214,400 | 5/1993 | Roos | 335/112 |

FOREIGN PATENT DOCUMENTS

| | | |
|---|---|---|
| 867 703 | 2/1953 | Germany . |
| 2 214 686 | 11/1972 | Germany . |
| 584 965 | 2/1977 | Switzerland . |

*Primary Examiner*—Michael L. Gellner
*Assistant Examiner*—Lee S. Lum
*Attorney, Agent, or Firm*—Burns, Doane, Swecker & Mathis, L.L.P.

[57] ABSTRACT

The invention relates to a matrix switching device (1) having a plurality of contact devices positioned in selected crosspoints between rows and columns, with each contact device including at least one movable contact element (2*a*). The device further includes a plurality of row-related, reciprocatingly movable first rods (3), a plurality of column-related reciprocatingly movable second rods (4, 4'), a plurality of electrically insulating balls (2*h*, 2*g*) of which each is allotted a selected crosspoint and is movable in response to movement of one or both of the rods (3, 4). Two mutually adjacent balls (2*g*, 2*h*) are provided at each selected crosspoint. A first ball (2*g*) has a larger diameter than a second ball (2*h*), and the first ball is so dimensioned that when moving it causes the movable contact element (2*a*) to move in one direction, and the second ball (2*h*) is so dimensioned as to have no effect on the movable contact irrespective of said movement. The second ball (2*h*) is adapted to impart movement to said first ball (2*g*).

17 Claims, 7 Drawing Sheets x (y)

y (x)

MATRIX-RELATED SWITCHING ARRANGEMENT INCLUDING MOVABLE RODS AND BALLS

FIELD OF THE INVENTION

The present invention relates to a matrix-related jumpering arrangement.

More particularly, there is proposed in accordance with the invention a matrix crosspoint switching device or jumpering device which has a plurality of selected crosspoints between rows and columns of contact devices where each contact device includes at least one movable contact element, normally in the form of a movable contact spring that can be moved towards and away from a fixed contact element by means of a movable actuating element.

The movable contact spring and the fixed contact element related thereto are included in an electric circuit, via conductors, which is either closed or broken according to the positional setting of the movable contact spring.

The crosspoint switching device includes a plurality of elements which are allotted to respective movable contacts and which make or break said contacts, wherein said elements are actuated with the aid of a row of reciprocatingly movable first rods and a column of reciprocatingly movable second rods.

According to the invention, the actuating elements are comprised of electrically insulating balls disposed at selected crosspoints between rows and columns, wherein respective balls are allotted a chosen crosspoint and are actuable by and movable in response to movement from one or both of the crosspoint-related rods.

It will be understood from this that each crosspoint-related ball can be moved between different positions in response to movement of a row-related rod in the crosspoint and in response to movement of a column-related rod in the crosspoint, where movement towards and into a first position creates conditions for said ball to move a contact-related contact element in a first direction,- while movement towards and into a second position creates conditions whereby the ball causes the aforesaid contact-related contact element to move in a second direction.

DESCRIPTION OF THE BACKGROUND ART

Several different designs of matrix crosspoint switching devices of the kind defined in the introduction are known to the art and adapted for different applications.

With regard to the constructive design of these switching devices, it may be appropriate to divide the same into different categories.

A first category utilizes a contact device which includes electrically conductive balls placed in selected crosspoints between first and second rods arranged in rows and columns, where electrically conductive balls associated with respective rods can be moved to a position in which the ball (as a movable contact element) is able to make an electric circuit terminating in two fixed contacts, or to a position in which the ball breaks the circuit.

The following publications are recited as examples of prior art disclosures in this regard:

U.S. Pat. No. 4,954,674

This publication describes and illustrates a matrix crosspoint switching device which makes, breaks or switches contacts between a plurality of first conducting pairs and a plurality of second conducting pairs.

The device includes a connection block that has a plurality of cavities (H1) containing crosspoints of the pluralities of conductor pairs, said cavities (H1) accommodating a first ball 1 (electrically conductive) and a second ball 2 (electrically insulating).

The ball (1) rests against two metal tongues (51, 52) which extend into the cavity in the x-direction from a y-conductor (5) moulded in the block (K).

A leaf-spring (61) extends in the z-direction from an x-conductor (6), which as the y-conductor (5) is moulded in the block (K).

The electrically conductive ball (1) makes contact with an outwardly bent tongue (61*a*) of the leaf spring.

The balls (1–4) are positioned In the cavity (H1) such as to provide electric contact between incoming conductor pairs (9, 6) in the x-direction and outgoing conductor pairs in the y-direction.

U.S. Pat. No. 5,214,400

This publication describes and illustrates a switching device for electrically making or breaking an electric circuit allocated a selected crosspoint from among a plurality of available crosspoints in a three-dimensional switching matrix.

This device includes three different actuator elements, each including a plurality of rods and used to move an electric contact element placed in the proximity of a selected crosspoint.

The contact elements have the form of balls, one electrically conductive and one electrically insulating, so as to enable a crosspoint-related circuit to be made or broken.

A rod (11*a* ), referred to as an x-rod and including a first actuating element (11) can be moved in the x-direction from a neutral position (broken lines) to an active position.

A contact making element (10), which is placed initially outside the crosspoint but in the proximity thereof in a recess in the rod in one position (1), is moved by the rod (11*a*) to a new position (2), and a rod (12*a*), referred to as a y-rod and included in a second actuating element (12), is perpendicularly movable to the rod (11*a*) in the x-direction.

The rod (12*a*) is moved from its neutral position to an active position and the contact element (10) is moved to a position (3) and is placed in a recess in a rod (13*a*), a z-rod, included in a third actuating element (13).

The rod (13*a*) can be moved in the z-direction perpendicularly to both the x-rod (11*a*) and the y-rod (12*a*), and is used as a make/break function during movement of the contact element (10) to and from a chosen position (4).

DE 2 214 686

This publication illustrates and describes a matrix contact device having a ball-shaped contact element.

The electrically conductive ball (6) can be brought to a contact-making position (7) or a contact-breaking position by actuator means (13).

DE-A 867 703

This publication describes and illustrates a switching device which comprises rods that are movable reciprocatingly in the x-direction and y-direction. The rods are provided with grooves which function to move an electrically conductive ball situated in a selected crosspoint towards and away from electric contacts positioned at said crosspoint.

A second category uses contact devices located in selected crosspoints between rods arranged in rows and columns, said contact device including at least one movable contact element in the form of a movable contact spring which can be moved towards and away from a fixed contact by actuator means.

The following publications disclose examples of this second category of such switching devices:

U.S. Pat. No. 3,662,301

This publication discloses a switching system having a plurality of coordinate-related contact setups orientated in rows and columns.

The system includes reciprocatingly movable actuating rods adapted for actuation of a crosspoint-related contact setup.

The contact setup is adapted for plug-in coaction with a panel (16) having circuits (18) formed on boards or panels in a manner typically known in printed circuit board techniques.

U.S. Pat. No. 3,711,670

This publication illustrates a switching system which includes a plurality of coordinate-related contact setups orientated in rows and columns.

Contact setups in the form of contact springs are provided in the crosspoints, and the system includes an actuator means which can be moved by angle-related rods to a contact-spring actuating position or to a contact-spring releasing position.

U.S. Pat. No. 2,647,166 and CH-A5 584 965 are also pertinent publications in the present context.

The present invention can be considered to belong to the category in which crosspoint-related contact devices include a movable contact element in the form of a movable contact spring, and in which movement of the contact spring to an open or a closed state is effected by movement of an electrically insulating ball.

SUMMARY OF THE INVENTION

Technical Problems

When considering the earlier standpoint of techniques as disclosed in the aforegoing, it will be seen that a technical problem resides in providing a novel and improved matrix crosspoint switching device which can be produced in functionally reliable and compact module units.

A technical problem also resides in providing a crosspoint switching device of the aforesaid kind that can be constructed from only a few parts and a plurality of similar parts, said parts being well-suited for mass production and for automatic assembly.

Another technical problem resides in the production of matrix switching devices where printed circuit board techniques can be used to a great extent for each part of the complete device.

A further technical problem is one of utilizing effectively one, two, three or four printed circuit boards in a crosspoint switching device, by mounting crosspoint-related, movable contact springs directly to the printed surface of one or two circuit boards.

It will also be seen that a technical problem resides in the provision of conditions which will allow two movable crosspoint-related contact springs to be actuated by one and the same actuating device, by positioning said two contact springs on a respective side of said actuating device, each to its respective circuit board.

Another technical problem is one of providing conditions in a crosspoint switching device such that a certain actuation of a selected contact device in a crosspoint between a chosen row and a chosen column will not be affected detrimentally when actuating another selected contact device belonging to said selected row or said selected column.

A technical problem also resides in providing conditions which will provide a crosspoint switching device of low height, e.g. a height beneath 7 mm, even when respective contact devices are configured with two mutually opposite movable leaf springs fastened to a respective circuit board and actuable by one and the same actuating device.

When considering the earlier standpoint of techniques as described above, it will also be seen that a technical problem resides in providing a matrix switching device that can provide two crosspoint-related contact functions, where each can comprise an alternating function with each contact function including at least one movable contact element in the form of a contact spring.

It will also be seen that a technical problem resides in realizing the significance of mounting on said printed circuit board movable contact elements in the form of contact springs adjacent recesses in said board to provide room for requisite actuating devices.

Another technical problem resides in the provision of conditions whereby the requisite contact pressure between a movable contact spring and a corresponding fixed contact surface can be readily adapted, said fixed contact surface being present on a printed circuit board.

It will be seen that a further technical problem is one of realizing the significance of permitting selected crosspoints to be allocated two mutually adjacent, electrically insulating balls and therewith to realize the significance of allowing a first ball to have a larger diameter than a second ball.

It will also be seen that a further technical problem is one of realizing the significance of and the advantages afforded by allowing the first ball to be dimensioned such as to move the movable contact spring in a certain direction at a movement of the first ball, and to dimension the second ball such as to have no effect on the movable contact spring irrespective of the movement of said second ball.

It will also be seen that a technical problem resides in realizing the significance of and the advantages afforded by configuring the row-related first rods and the column-related second rods such that movement of the second ball by said rods will also result in movement of the first ball.

With regard to a switching device of compact design, it will be seen that a further technical problem is one of creating conditions whereby one and the same first ball in respective selected crosspoints is able to actuate two movable contact springs, one on each side of an actuating device, wherein said contact springs can be actuated simultaneously.

It will also be seen that a technical problem resides in realizing the significance of enabling the first ball to move within a configured recess or aperture in the longitudinal direction of the contact spring and also perpendicular thereto.

Another technical problem is one of realizing the significance of providing a printed circuit board, onto which the movable contact device is attached, with rows and columns of L-shaped recesses that are related to respective crosspoint-related contact devices, and intended to provide an opening which will enable the movable contact spring to be actuated by the first ball.

With regard to the manufacture of a matrix switching device of the kind defined in the introduction, it will be seen that a technical problem resides in realizing the significance of employing printed circuit technology, and therewith of proposing the use of-an intermediate plate and to provide said plate with recesses, slots or grooves and position said plate centrally (in relation to the ball).

A further technical problem resides in realizing the significance of and the conditions for inserting reciprocatingly movable row-related rods into the grooves or slots in the intermediate plate.

A further technical problem resides in realizing the significance of allowing the row-related rods to be centrally related and to cause a rod to actuate row-orientated balls.

Another technical problem is one of realizing the significance of utilizing two column-related rods that have synchronous movement and are located on a respective side of a row-related rod.

Another technical problem is one of realizing the significance of creating conditions which will enable column-related rods to be placed between a printed circuit board and said intermediate plate.

In this regard, it will be seen that a technical problem is one of realizing the significance of positioning two column-related rods parallel with one another and actuable for movement within one and the same slot or groove in a plate or spacing plate.

It will also be seen that a technical problem is one of realizing the significance of providing respective column-related rods with a plurality of crosspoint-related recesses, each having a pronounced T-shape.

In this regard, it will be seen that a technical problem is one of realizing the significance of providing respective row-related rods with a plurality of edge-related crosspoint-associated recesses, wherein the recesses along one edge of the rod are offset in relation to the recesses along the opposite edge of the rod.

Another technical problem is one of realizing the significance of and the advantages associated with two column-related rods that are coordinated adjacent one another and guided by a slot in a spacing plate, in combination with two row-related rods that are coordinated adjacent one another and guided by a respective slot in a spacing plate.

It will also be seen that a technical problem is one of providing a matrix switching device in a crosspoint-related first rod and a crosspoint-related second rod must move in a specific movement pattern in order for a crosspoint-related first ball to be moved for specific actuation of crosspoint switching means to a stable position and that subsequent movement of solely one of the rods will not affect the position of the earlier displaced first ball and the setting of the switching device.

Solution

With the intention of solving one or more of the aforesaid technical problems, the present invention takes as its starting point a matrix switching device having a plurality of contact devices orientated in rows and columns in selected crosspoints, with each contact device including at least one movable contact element, a plurality of row-related reciprocatingly movable first rods, a plurality of column-related reciprocatingly movable second rods, electrically insulating balls disposed in selected crosspoints between rows and columns, wherein respective ball allocated a selected crosspoint is actuable and movable in response to movement of one or both of the crosspoint-related rods, wherein each crosspoint-related ball is movable between different positions where movement towards and into a first position creates conditions for said ball to cause a movable contact element belonging to said contact device to move in a first direction, and movement towards and into a second position creates conditions which cause said ball to move the movable contact element of said contact device in a second direction. In accordance with the present invention, it is proposed that in a matrix switching device of this kind selected crosspoints are allocated two mutually adjacent, electrically insulating balls of which a first ball has a larger diameter than a second ball, that the first ball is dimensioned to cause the movable contact element to move in one direction in response to movement of said rod or rods, whereas the other second is dimensioned to leave the movable contact unaffected irrespective of said movement, and that said second ball is adapted to cause said first ball to move.

By way of proposed embodiments that lie within the scope of the inventive concept, it is also proposed that the movable contact element of said contact device is comprised of a contact spring mounted on a printed circuit board.

It is also proposed that the contact spring is adapted to rest against a contact surface on the printed circuit board at an adapted contact pressure.

It is also proposed that two crosspoint-related contact springs, one on each side of a central plane, can be actuated simultaneously.

The first ball is movable in the longitudinal direction of the contact spring and also perpendicularly thereto.

It is also proposed that a printed circuit board is provided with rows and columns of recesses where each recess is related to a respective crosspoint-related contact device and has an L-shape.

According to the present invention, the matrix switching device may be comprised, among other things, of a centrally related intermediate plate provided with slot-like grooves or recesses.

Said column-related rods are conveniently placed between a printed circuit board and an intermediate plate.

It is also proposed that two column-related rods are parallel and actuable for movement within a slot.

According to the invention, respective column-related rods are conveniently provided with a plurality of crosspoint-related recesses having a pronounced T-shape.

It is also proposed that respective row-related rods are provided with a plurality of edge-related, crosspoint associated recesses on two opposing edges of the rod and that the recesses along one edge are mutually offset in relation to the recesses along the other edge in a lateral direction.

It is also proposed in accordance with the invention that two column-related rods are coordinated adjacent one another and guided by a slot in a spacing plate.

It is also proposed that each row-related rod is guided by a slot in an intermediate plate which serves as a spacing plate.

It is also proposed in accordance with the invention that a crosspoint-related first rod and a crosspoint-related second rod must move in a specific patter in order for a crosspoint-related first ball to be displaced and for the movable contact device in the form of a contact spring to be actuated, whereas movement of solely said first rod or of solely said second rod will have no effect on movement of the first ball.

Advantages

Those advantages that are primarily afforded by an inventive matrix switching device reside in the creation of conditions for obtaining a compact construction while utilizing printed circuit board technology, such that the movable contact spring of the contact device can be mounted on said circuit board and the fixed contact surface can be formed on said board, and thereby provide conditions for adapting the contact pressure of the movable contact spring against the fixed contact surface in a closed position.

Another advantage is that the matrix switching device requires no energy to hold a selected contact device in a circuit-making or circuit-breaking position.

The main characteristic features of an inventive matrix switching device are set forth in the characterizing clause of the following claim 1.

BRIEF DESCRIPTION OF THE DRAWINGS

An embodiment of an inventive matrix switching device at present preferred and having the significant characteristic features of the invention, and a proposed application, will now be described with reference to the accompanying drawings, in which.

DETAILED DESCRIPTION OF PREFERRED EMBODIMENTS

The present invention relates to a matrix switching device 1.

Figure 1:
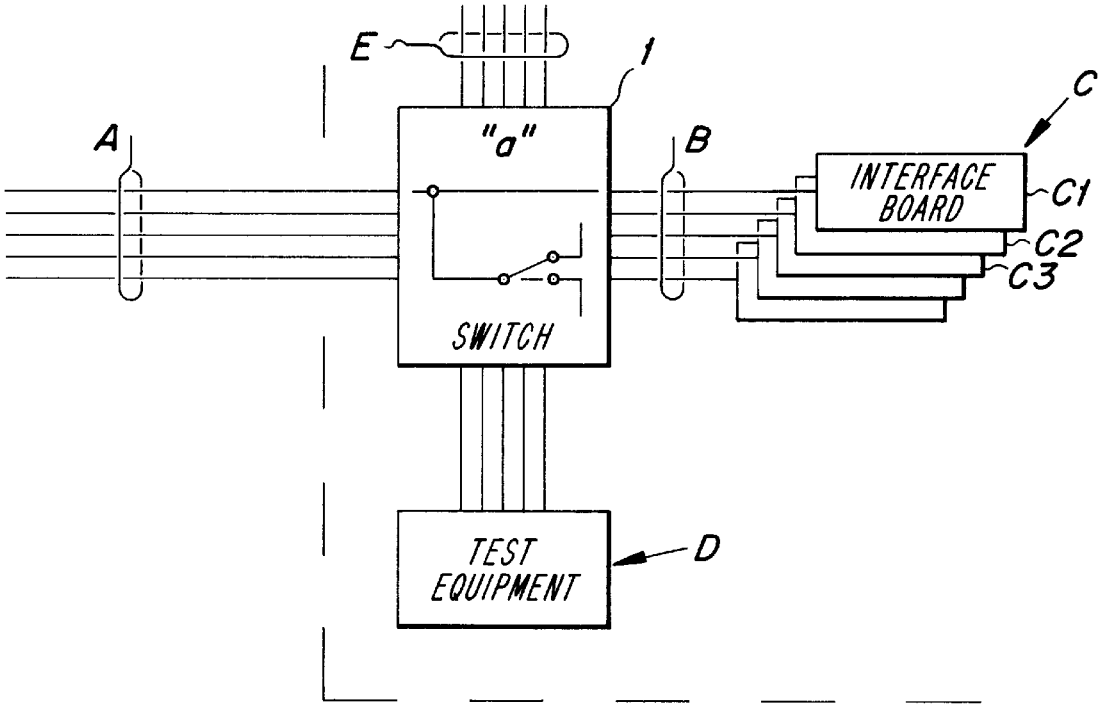
FIG. 1 illustrates one of several possible use applications of a matrix crosspoint switching device.

Such devices can be used in many applications, of which one is shown in FIG. 1 where the switching device 1 is assumed to be installed in a telecommunications exchange or switching centre and positioned between incoming conductors forming a conductor bundle A and a conductor bundle B incoming to line interface boards C, where each of said boards (C1–C3) is connected to a respective conductor.

Signals on each selected conductor can be switched by the switching device 1 to test equipment or to a line interface board reserve unit or the like D and/or to one of the conductors in a further conductor bunch E.

The symbol within the block that represents the switching device 1 is intended to illustrate that signals occurring on conductor "a" can be either switched by a crosspoint-related contact device to a conductor in the conductor bundle E (or open conductor) or to the test equipment D or the like.

Figure 2:
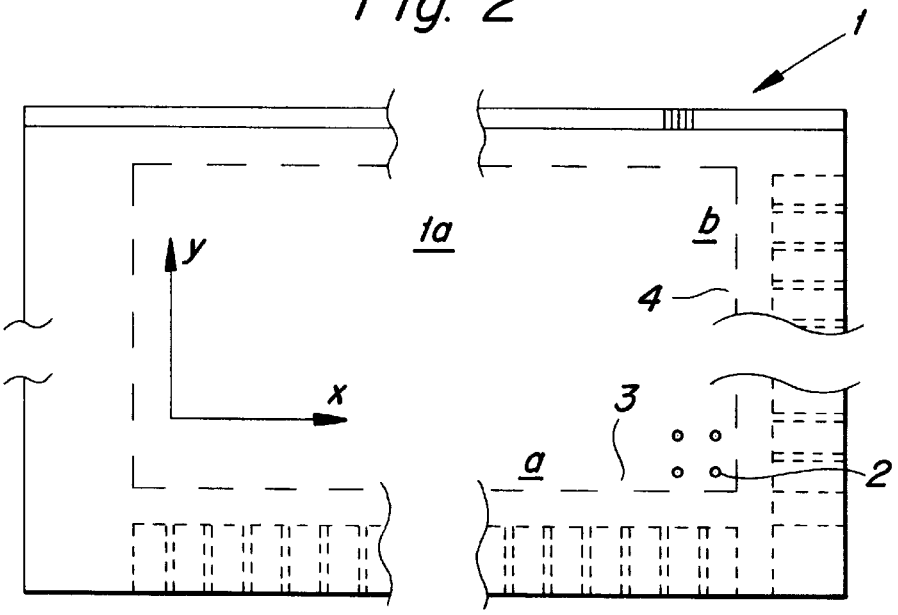
FIG. 2 is a simplified illustration of a matrix switching device from above.

FIG. 2 is a simplified view from above of a matrix switching device 1 where a matrix-related surface la has been allocated directions "x" and "y" to enable the invention to be understood more readily.

It will be understood that the given directions can be changed without departing from the inventive concept.

The switching device 1 has a plurality of contact devices orientated in selected crosspoints between rows and columns. Since it can be assumed that all contact devices are mutually identical, only the contact device 2 located in the crosspoint between a row "a" and a column "b" will be described in the following.

Each contact device, such as the contact device 2 described in more detail with reference to FIGS. 4 and 5 below, includes at least one movable contact element in the form of a movable contact spring 2*a,* the actuation of which will be described in more detail below.

The switching device 1 also includes a plurality of row-related reciprocatingly movable first rods, of which the rod in row "a" is referenced 3.

The device also includes a plurality of column-related reciprocatingly movable second rod where the rods belonging to column "b" is referenced 4 and will be described in more detail below.

According to the invention, electrically insulating balls 2*g,* 2*h* are arranged in selected crosspoints between rows and columns, wherein respective balls allocated to a selected crosspoint 2 are actuable by and moved in response to movement of one or both of said crosspoint-related rods 3, 4.

Figure 4:
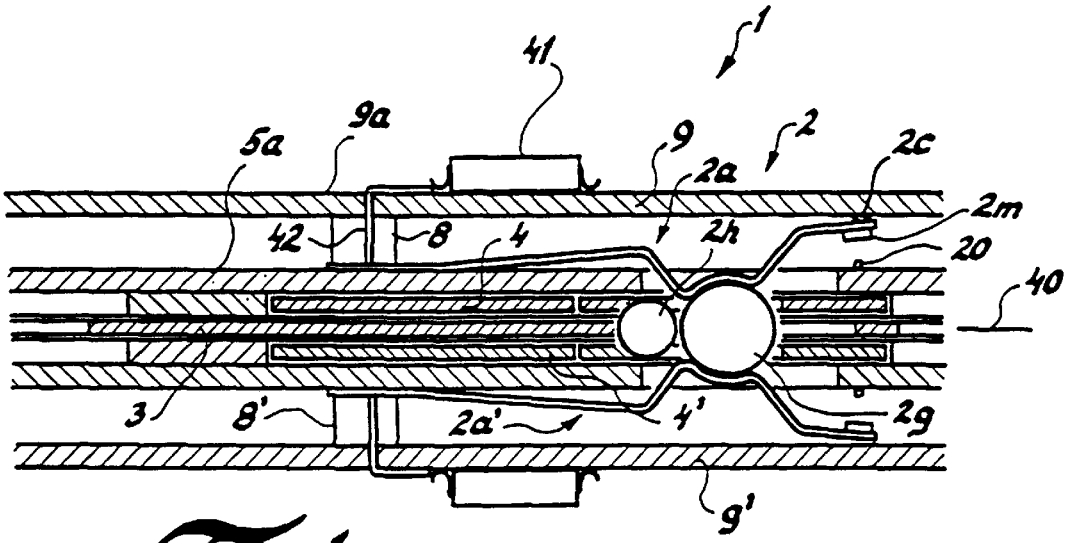
FIG. 4 illustrates a contact device positioned in a crosspoint between a row and a column and shown in a circuit breaking position.
Figure 5:
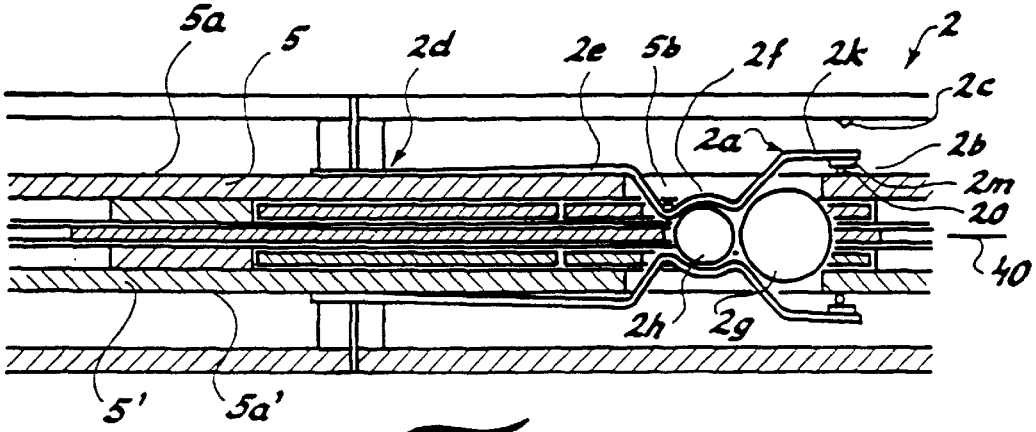
FIG. 5 shows the contact device of FIG. 4 in a circuit-making position.

Each crosspoint-related ball 2*g* can be moved between different positions, shown in FIGS. 4 and 5, where movement towards and into a first position creates conditions for the ball to move a contact element 2*a* of a contact device 2 in a first direction, while movement towards and into a second position creates conditions for said ball to move the contact element 2*a* of said contact device in a second direction.

Selected crosspoints, such as the crosspoint 2, shall be allocated two balls 2*g,* 2*h* which are positioned adjacent one another and of which a first ball 2*g* has a larger diameter than a second ball 2*h*.

Figure 13:
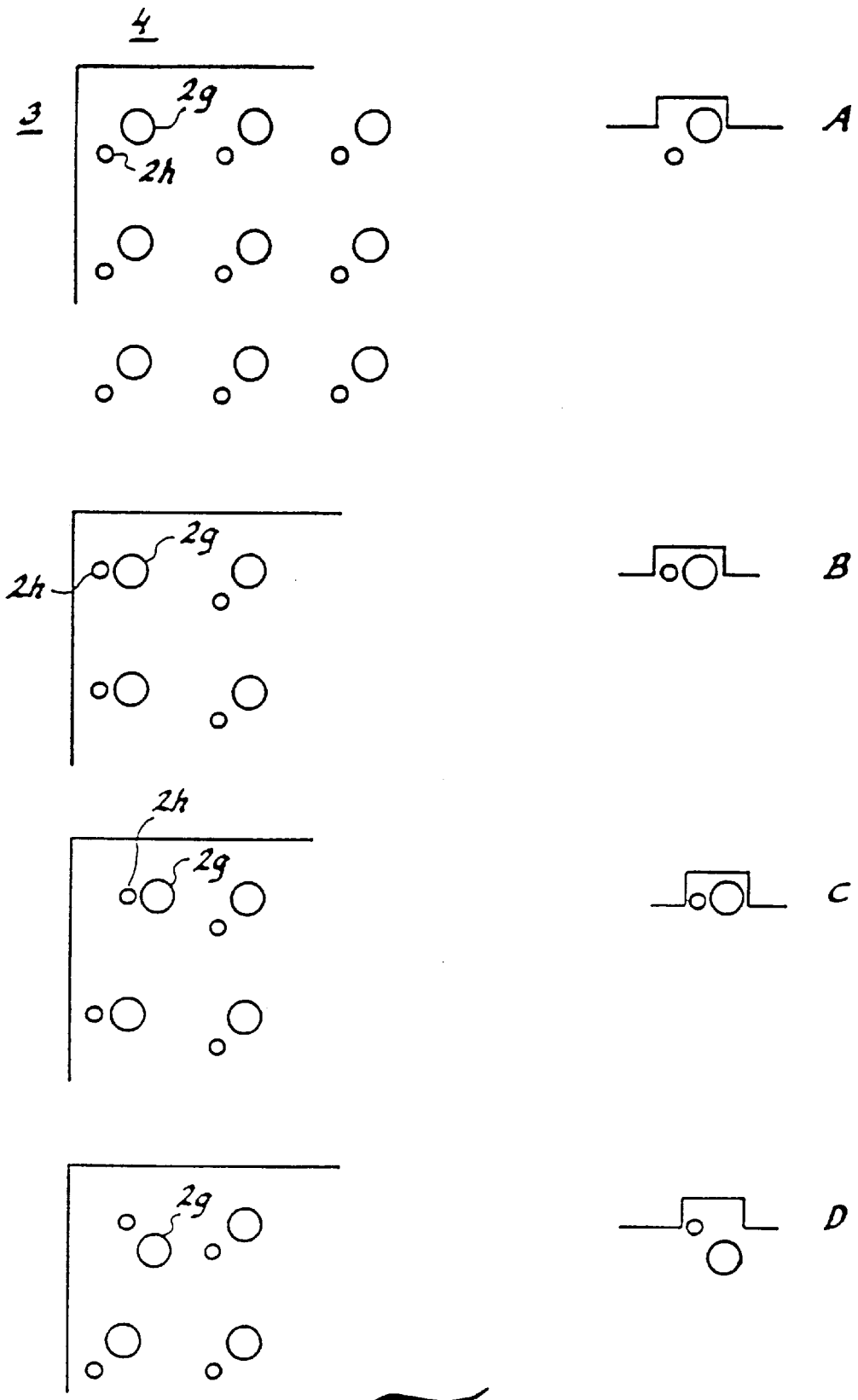
FIG. 13 shows the different positions of two electrically insulating balls for actuating the movable contact spring within a contact device.

The first ball 2*g* is dimensioned to move the contact element or contact spring 2*a* in one direction, while the other ball 2*h* is dimensioned so as not to affect the movable contact 2*a* as the ball moves and is adapted to impart movement to the first ball in a manner hereinafter described in more detail with reference to FIG. 13.

The movable contact element 2*a* of the contact device 2 is comprised of a contact spring mounted on a printed circuit board.

The board is referenced 5 and its upper surface 5*a* is provided with an electrically conductive layer in which a circuit pattern is formed; FIGS. 4 and 5.

The contact spring 2*a* is attached to the layer 5*a* at 2*d* in a known manner.

The technique of applying a conductor pattern to the surface of an electrically insulating carrier is known to the art and will not therefore be described in detail here.

Neither has the circuit-mounted surface 5*a* been shown, for the sake of clarity.

Seen from its attachment point 2*d,* the contact spring 2*a* comprises a straight section 2*e,* a section 2*f* which is curved towards a central plane 40, and a section 2*k* on which a contact surface 2*m* is mounted.

The section 2*f* has a part-circular section whose radius of curvature corresponds to or is slightly smaller than the radius of curvature of the larger ball 2*g*.

The part circular sections of two opposing and closely adjacent contact springs 2*a,* 2*a′* will form an enclosure which can fully accommodate the smaller ball but which is unable to accommodate the larger ball without said ball moving the contact springs 2*a,* 2*a'* away from one another.

Fixedly mounted on the layer 5*a* for each contact device 2 is a contact 20 against which the movable contact 2*m* rests at a predetermined contact pressure when the smaller ball 2*h* is positioned in the enclosure 2*f,* as shown in FIG. 5.

The desired contact pressure is achieved by the manufacturing method used to fasten the movable contact springs to the layer 5*a*.

The circuit board 5 has only one layer 5*a* on which conductors are printed.

The circuit board 5' is also provided with a single layer 5*a'* for printed circuits.

FIGS. 4 and 5 also clearly show that two contact springs 2*a,* 2*a'* are allotted respective crosspoints and contact devices 2 and respective layers 5*a,* 5*a',* and that these are actuable simultaneously towards and away from one another as a result of displacement of the balls 2*g,* 2*h*.

The first ball 2*g* is movable generally in the longitudinal direction of the contact spring when displaced from the position shown in FIG. 4 to the position shown in FIG. 5, and also perpendicular to this direction, and vice versa.

Figure 3:
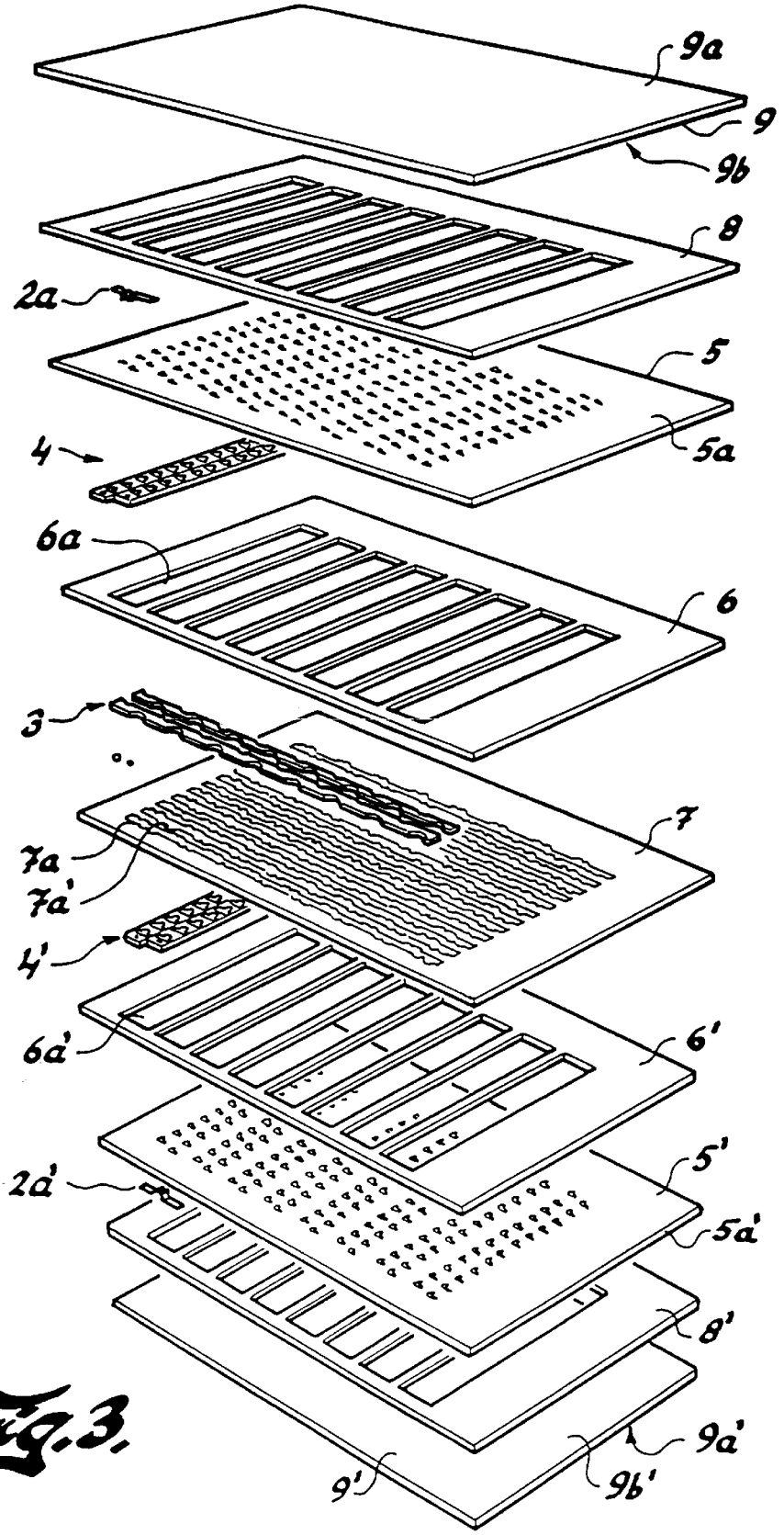
FIG. 3 is an exploded view of part of the switching device shown in FIG. 1.

FIG. 3 is an exploded view of part of the switching device shown in FIGS. 1 and 2.

FIG. 3 illustrates a printed circuit board 5 having a surface 5*a* which, although not shown, is provided with an electrically conductive pattern.

The Figure also shows the use of a contact device and having a movable contact spring 2*a* which shall be fastened to the surface 5*a* in a known manner, as previously mentioned.

Positioned beneath the board 5 are a plurality of rods 4 which are placed in pairs in recesses 6*a* formed in a spacing plate 6. Row-related first rods 3 are orientated in respective recesses 7*a,* 7*a'* in an intermediate plate 7.

Additional column-related second rods 4' are placed in pairs in respective recesses 6*a'* in a plate 6'.

Also provided is a plate 5' having a printed circuit surface 5*a'* similar to the plate 5.

The illustrated switching device also includes a spacing plate 8 and a spacing plate 8' which function to protect the contact devices, and then particularly the movable contact springs 2*a* and 2*a'* respectively.

The spacing plates 8 and 8' are covered by a respective plate 9 and 9', whose outer surface 9*a,* 9*a'* and/or inner surface 9*b,* 9*b'* may be provided with a patter of electrical conductors.

In connection herewith, it will be seen from FIGS. 4 and 5 that a conductor 42 can be drawn through the plate 8 (8') from the movable contact attachment 2*d* to the surface 9*a,* to which discretely components 41 or the like can be fastened.

Figure 6:
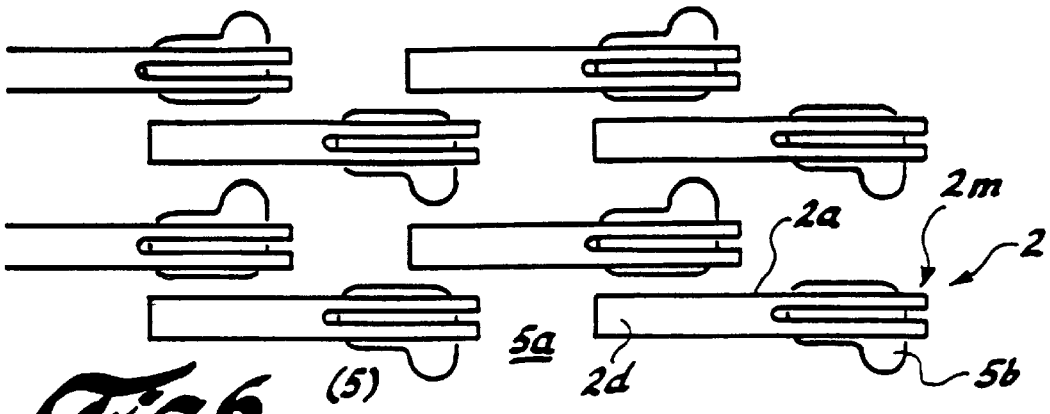
FIG. 6 is a view from above of the circuit-mounted surface of a printed circuit board with movable contact springs mounted on said surface.
Figure 7:
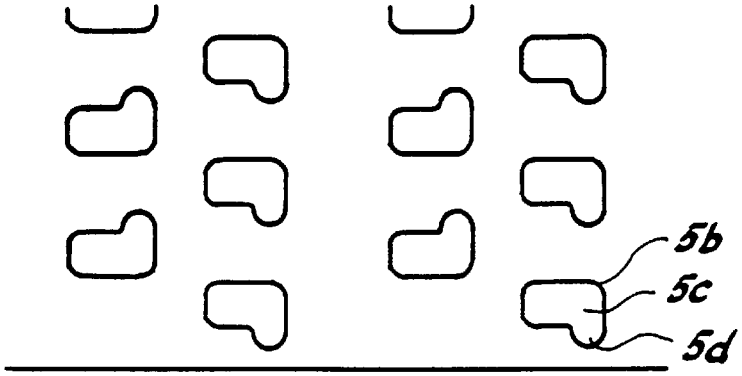
FIG. 7 shows the surface according to FIG. 5 with no movable contact springs mounted thereon.

FIG. 6 illustrates the board 5 from above. Although not shown, the surface 5*a* carries a printed circuit and movable contact springs 2*a* are positioned at each crosspoint in a row and column.

The contact device 2 there presents the movable contact spring 2*a* which extends over and beyond an recess 5*b* in the card 5. The recesses 5*b* of one column are identical to the recesses of an adjacent column, but turned through 180°.

The recess or groove 5*b* has a generally L-shape of which one leg 5*c* is broader and longer than the other leg 5*d,* and is dimensioned so that the ball 2*g* is able to move along the legs, i.e. along the leg 5*c* in the longitudinal direction of the contact spring and along the leg 5*d* in a perpendicular direction thereto.

Figure 8:
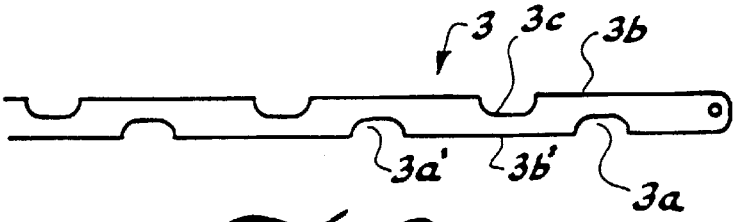
FIG. 8 shows a row-related first rod from above.

It will be seen from FIG. 8 that each row-related rod or bar 3 is provided along mutually opposite edges thereof with a plurality of crosspoint-related recesses 3*a,* 3*a'*, and that the recesses on one edge are offset in relation to the recesses on the opposite edge, such that the recess 3*a* will be associated with the column "b" and the recess 3*c* associated with an adjacent column.

Figure 9:
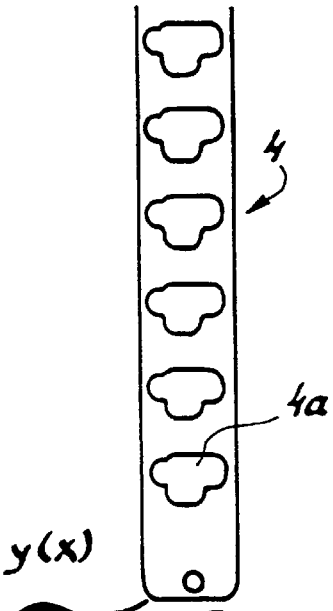
FIG. 9 shows a column-related second rod from above.

FIG. 9 shows a column-related rod or bar 4 from above, and it will be seen from the Figure that the rod is provided with a plurality of crosspoint-related recesses or apertures 4*a* of a pronounced T-shape, said recesses or apertures being dimensioned for movement of the balls in response to movement of the rod.

Figure 10:
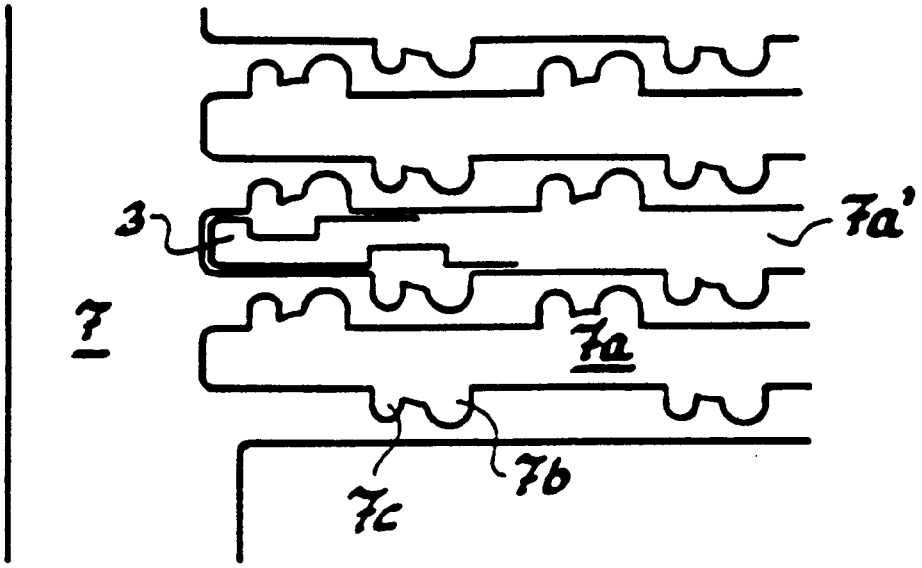
FIG. 10 shows an intermediate plate containing parallel slots from above.

FIG. 10 illustrates part of the intermediate plate 7 which includes recesses 7*a,* 7*a'* that function to enclose and guide a respective rod 3 shown in FIG. 8. The recess 7*a* is provided with edge-related recesses 7*b,* 7*c,* of which one recess 7*b* is adapted to the first ball and the second recess 7*c* is adapted to the second ball.

FIG. 10 also illustrates coaction between a recess 7*a'* and a rod 3 which takes an end position but can be moved slightly to the right in FIG. 10.

Figure 11:
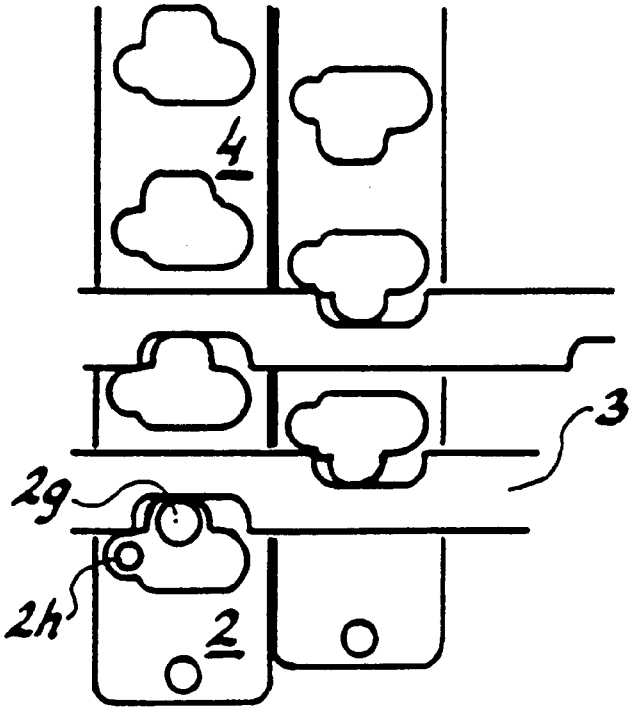
FIG. 11 illustrates the coaction between first rods and second rods unique to the invention.
Figure 12:
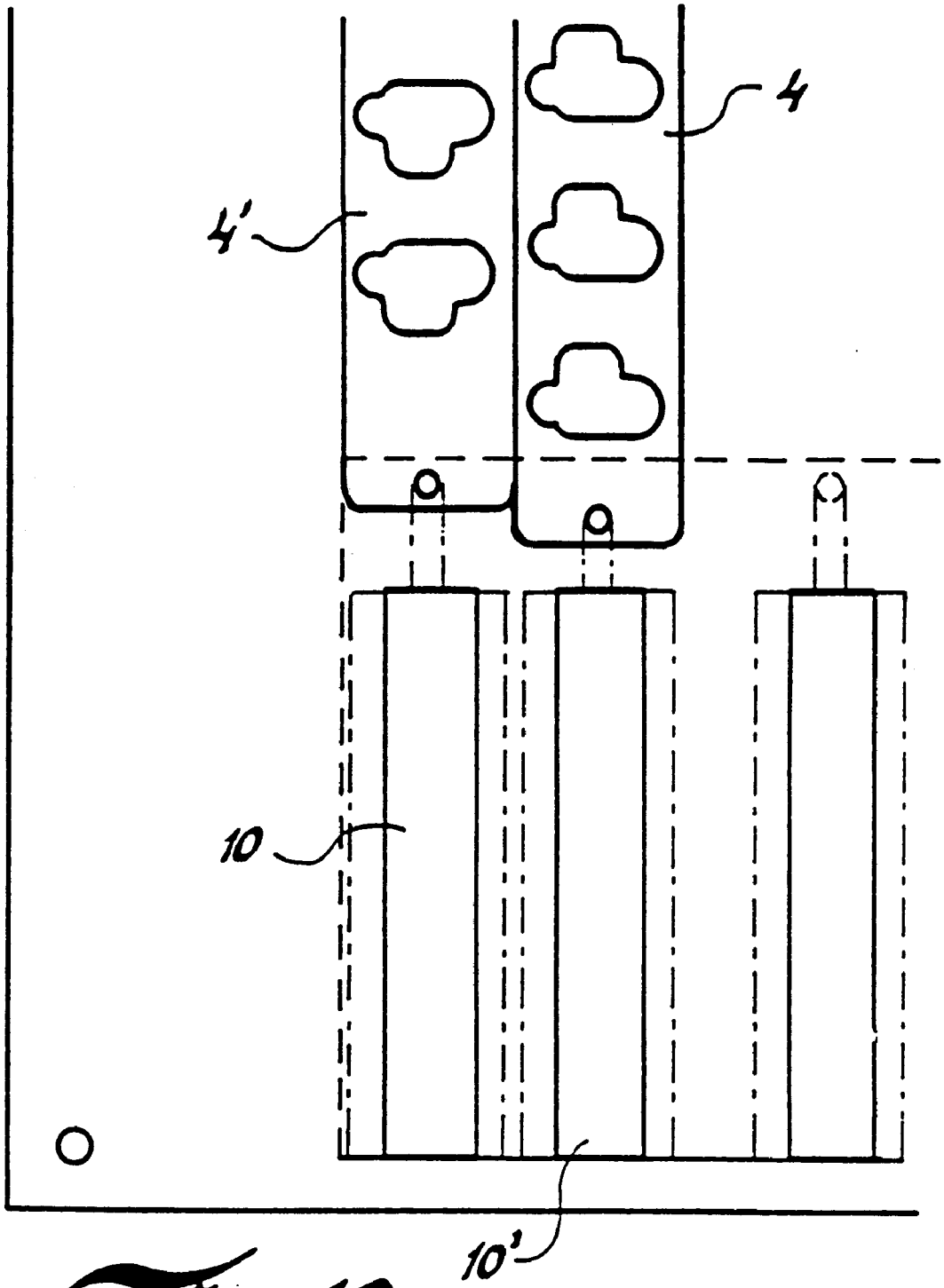
FIG. 12 is a horizontal view of means for moving column-related second rods backwards and forwards.

FIG. 11 illustrates the intended coaction between the first rod 3 and the second rod 4 in the crosspoint where the contact device 2 is placed.

The second rod 4 can be moved up and down by a solenoid 10 and the rod 4' is similarly actuable by a solenoid 10'.

Correspondingly, the first rod 3 can be moved forwards and backwards by corresponding solenoids, indicated in FIG. 1 but not described in detail.

The pattern of movement of the balls 2*g,* 2*h* will be described more clearly with reference to FIG. 13, which illustrates displacement of the rods 3 and 4 where position A is intended to illustrate an initial position according to FIGS. 4 and 11.

In position B, all small balls (2*h*) in a column are moved upwards in the Figure by a column-related actuator rod 4, wherewith the balls 2*g* and 2*h* will be located immediately adjacent one another and row-related.

In position C, a small and a large ball 2*g,* 2*h* (row-orientated) have been moved slightly to the left by a row-orientated actuator rod 3.

In position D, a large ball 2*g* has been moved down by a column-related actuator rod 4 and therewith influences the contact in the chosen crosspoint and the contact device 2 takes the position shown in FIG. 5.

The illustrated switching device is comprised of sheets, boards or plates adapted for the manufacture of printed circuit boards.

The boards 5, 6, 7, 9 and the boards 5', 6' and 9' may conveniently have a thickness of 0.5 mm, whereas the boards 8 and 8' will suitably have a thickness of 0.8 mm.

If the boards 9 and 9' are provided with printed circuits on both sides (9*a,* 9*b* and 9*a'*, 9*b'*), the sides 9*a* and 9*a'* can be used to carry board components, although this will increase the thickness of the device.

It will be understood that the invention is not restricted to the aforedescribed and illustrated exemplifying embodiment thereof and that modifications can be made within the scope of the inventive concept defined in the following claims.

I claim:

1. A matrix switching device having a plurality of contact devices positioned in selected crosspoints between rows and columns, wherein each contact device includes at least one movable contact element, a plurality of row-related, reciprocatingly movable first rods, a plurality of column-related, reciprocatingly movable second rods, a plurality of electrically insulating balls, wherein respective balls allocated a selected crosspoint are actuable and movable in response to movement of one or both of the rods, wherein each crosspoint-related ball is movable between different positions where movement towards and into a first position creates conditions where said ball moves the movable contact element of a contact device in a first direction, while movement towards and into a second position creates conditions in which said ball moves the movable contact element of said contact device in a second direction, characterized in that selected crosspoints are allotted two mutually adjacent balls; in that a first ball has a larger diameter than a second ball; in that the first ball is so dimensioned that when in motion it causes the movable contact element to move in one direction, and the second ball is so dimensioned as to have no affect on the movable contact irrespective of said movement; and in that said second ball is adapted to be able to impart movement to said first ball.

2. A device according to claim 1, characterized in that the movable contact element is comprised of a contact spring mounted on a printed circuit board.

3. A device according to claim 2, characterized in that the contact spring rests on a board-carried contact surface at an adapted contact pressure.

4. A device according to claim 1, characterized in that two contact springs, one on each respective side of a crosspoint, are actuable simultaneously.

5. A device according to claim 1, characterized in that said first ball is movable in the longitudinal direction of the contact spring.

6. A device according to claim 1, characterized in that a printed circuit board is provided with rows and columns of recesses related to respective crosspoint-related contact devices.

7. A device according to claim 6, characterized in that respective recesses have an L-shape.

8. A device according to claim 1, characterized by a centrally related intermediate plate provided with groove-like recesses.

9. A device according to claim 1, characterized in that the row-related rods are placed between a printed circuit board and an intermediate plate.

10. A device according to claim 9, characterized in that two row-related rods are positioned parallel with one another and are actuable for movement within a recess.

11. A device according to claim 1, characterized in that respective column-related rods are provided with a plurality of crosspoint-associated recesses.

12. A device according to claim 11, characterized in that said recesses have a T-shape.

13. A device according to claim 1, characterized in that respective row-related rods are provided with a plurality of edge-related crosspoint-associated recesses.

14. A device according to claim 13, characterized in that two opposite edges of the rod are provided with said recesses, wherein the recesses on one edge are offset in relation to the recesses on the other edge.

15. A device according to claim 1, characterized in that two row-related rods are coordinated adjacent one another and guided by a slot in a spacing plate.

16. A device according to claim 1, characterized in that two column-related rods are coordinated adjacent one another and guided in a slot in a spacing plate.

17. A device according to claim 1, characterized in that definite movement of a crosspoint-related first rod and definite movement of a crosspoint-related second rod is required for displacement of a crosspoint-related first ball.

* * * * *